US009279286B2

(12) United States Patent
Higgins et al.

(10) Patent No.: US 9,279,286 B2
(45) Date of Patent: Mar. 8, 2016

(54) METHODS AND SYSTEMS FOR MECHANICALLY OPERATING A GROUP OF SHADES OR BLINDS

(71) Applicant: QMOTION Incorporated, Pensacola, FL (US)

(72) Inventors: Fred C. Higgins, Cantonment, FL (US); Willis Jay Mullet, Gulf Breeze, FL (US)

(73) Assignee: QMotion, Incorporated, Pensacola, FL (US)

( * ) Notice: Subject to any disclaimer, the term of this patent is extended or adjusted under 35 U.S.C. 154(b) by 0 days.

(21) Appl. No.: 13/804,782

(22) Filed: Mar. 14, 2013

(65) Prior Publication Data

US 2014/0262067 A1 Sep. 18, 2014

(51) Int. Cl.

| | |
|---|---|
| ***E06B 9/174*** | (2006.01) |
| ***E06B 9/42*** | (2006.01) |
| ***E06B 9/50*** | (2006.01) |

(52) U.S. Cl.

CPC . *E06B 9/174* (2013.01); *E06B 9/42* (2013.01); *E06B 9/50* (2013.01); *E06B 2009/1746* (2013.01)

(58) Field of Classification Search

USPC ..... 160/310, 120, 241, 323.1; 248/270, 258
IPC ..... E06B 9/174
See application file for complete search history.

(56) References Cited

U.S. PATENT DOCUMENTS

| | | | | |
|---|---|---|---|---|
| 2,341,217 | A * | 2/1944 | Holtzclaw | 248/265 |
| 3,298,197 | A * | 1/1967 | Roth | 464/182 |
| 4,657,059 | A * | 4/1987 | Clauss | 160/120 |
| 6,196,508 | B1 * | 3/2001 | Nijs | 248/267 |
| 7,625,151 | B2 * | 12/2009 | Li et al. | 403/102 |
| 7,854,419 | B2 * | 12/2010 | Ng et al. | 248/269 |
| 7,891,399 | B2 * | 2/2011 | Rasmussen | 160/120 |
| 8,016,016 | B2 * | 9/2011 | Berman et al. | 160/242 |
| 8,122,932 | B2 * | 2/2012 | Cannaverde | 160/120 |
| 2005/0183835 | A1 * | 8/2005 | Nien | 160/321 |
| 2006/0272782 | A1 * | 12/2006 | Nichols et al. | 160/120 |
| 2008/0153606 | A1 * | 6/2008 | Koop et al. | 464/83 |
| 2010/0252211 | A1 * | 10/2010 | Barnes et al. | 160/120 |
| 2011/0203754 | A1 * | 8/2011 | Mullet et al. | 160/405 |

* cited by examiner

*Primary Examiner* — David Purol
(74) *Attorney, Agent, or Firm* — Christopher A. Proskey

(57) ABSTRACT

A shade system includes a plurality of shade assemblies each including an elongated shade tube having an inner surface defining an inner cavity, an outer surface for winding receipt of a flexible shade, at least one coupling end, and an axis of rotation; a connector assembly having a first coupling unit secured to the inner surface at the coupling end of a first shade tube and a second coupling unit secured to the inner surface at the coupling end of a second shade tube substantially adjacent the first shade tube, the first coupling unit and the second coupling unit cooperating to transfer an applied torque from the first shade tube to the second shade tube; an end bracket for rotatably supporting a free end portion of a shade tube when attached to a supporting structure; and a mounting bracket for adjusting the connector assembly.

29 Claims, 17 Drawing Sheets

METHODS AND SYSTEMS FOR MECHANICALLY OPERATING A GROUP OF SHADES OR BLINDS

FIELD OF THE INVENTION

The present invention relates to window treatments. More particularly, the present invention relates to systems and methods for mechanically operating a group of shades or blinds to move in unison.

BACKGROUND OF THE INVENTION

Window coverings serve multiple functions. For example, window coverings may be used to shield or filter light, provide privacy, enhance security, and/or function as a decorative piece for a particular space or room. Common window coverings include blinds and roller shades.

Both blinds and roller shades typically use a bracket assembly located at the top or above the window to support the blinds or roller shade. To control the extent that a blind or shade is open, conventional systems often rely on simple mechanical controls, such as a ratchet and pawl mechanism or a clutch and chain system, to move the blind or shade up and down, and to position the shade at intermediate locations along a predetermined extent of travel.

As roller shade designs evolved, motor powered shades were desired. Motorization of the roller shade was accomplished, in one example, by replacing the simple, mechanical control system with an electric motor that is directly coupled to the shade tube. The motor may be located inside or outside the shade tube, is fixed to the roller shade support and is connected to a simple switch, or, in more sophisticated applications, to a radio frequency (RF) or infrared (IR) transceiver, that controls the activation of the motor and the rotation of the shade tube.

Many known motorized roller shades provide power, such as 120 VAC, 220/230 VAC 50/60 Hz, etc., to the motor and control electronics from the facility in which the motorized roller shade is installed. Recently-developed battery-powered roller shades provide installation flexibility by removing the requirement to connect the motor and control electronics to facility power. The batteries for these roller shades can be mounted within, above, or adjacent to the shade mounting bracket, headrail or fascia.

Often it is desirable to couple a group of blinds or shades move in unison. There are several conventional ways to mechanically link blinds or shades together so that the blinds or shades move in unison, particularly when actuated by motorized control. For example, flex cable systems may be used to transmit the rotational force between multiple shades and blinds. However, these conventional systems often induce substantial parasitic drag and require excessive power to operate. For battery powered blinds and shades, the need for excessive power to overcome the difficulties of conventional systems can quickly drain the power source, resulting in the frequent loss of automated control and the accompanying need to constantly replace the batteries to restore operation. Accordingly, it is desirable to provide a method and apparatus for linking a group of blinds or roll shades to reduce parasitic power loss when in a motorized configuration while maintaining aesthetic appeal and convenience of use.

SUMMARY OF THE INVENTION

Embodiments of the present invention advantageously provide systems and methods for mechanically operating a plurality of shades. One embodiment of a shade system includes a plurality of shade assemblies each including an elongated shade tube having an inner surface defining an inner cavity, an outer surface for winding receipt of a flexible shade, at least one coupling end, and an axis of rotation; a connector assembly having a first coupling unit secured to the inner surface at the coupling end of a first shade tube and a second coupling unit secured to the inner surface at the coupling end of a second shade tube substantially adjacent the first shade tube, the first coupling unit and the second coupling unit cooperating to transfer an applied torque from the first shade tube to the second shade tube, and an end bracket for rotatably supporting a free end portion of a shade tube when attached to a supporting structure. A mounting bracket includes an adjustment mechanism for applying an external force to the connector assembly along at least one axis substantially orthogonal to the axis of rotation of at least one of the first and second shade tubes for positional alignment of the connector assembly when the mounting bracket is attached to a supporting structure.

In accordance with other aspects of the present invention, the connector assembly includes a locating ring having an abutment surface for receiving the force of the adjustment mechanism and the adjustment mechanism includes an adjustment nut that is rotated to adjust the positional alignment of the connector assembly along the at least one axis substantially orthogonal to the axis of rotation of at least one of the shade tubes.

In accordance with yet another aspect of the present invention, the shade system may include a motor assembly provided in the inner cavity of at least one of the plurality of shade tubes, wherein actuation of the motor assembly controls the uniform movement of the plurality of shades. The system may further include a radio frequency (RF) motor controller assembly, a power supply assembly, and/or a counterbalance assembly mounted in the inner cavity of at least one separate shade tube from the shade tube containing the motor assembly.

In accordance with another aspect of the present invention, the first and second coupling units are configured to permit passage of wiring to electrically connect the motor assembly and one or more of the RF motor controller assembly and the power supply assembly.

In accordance with certain other aspects of the present invention, the first and second coupling units are coupled via a drive journal. The drive journal may include a ball end portion and the first coupling unit may include a socket for receiving the ball end portion to define a constant velocity joint for transferring torque between adjacent shade tubes positioned with angularly aligned axes of rotation.

There has thus been outlined, rather broadly, certain embodiments of the invention in order that the detailed description thereof may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The accompanying drawings, which are incorporated in and constitute a part of this specification, illustrate various embodiments consistent with the invention, and, together with the description, serve to explain the principles of the invention.

DETAILED DESCRIPTION

Figure 1:
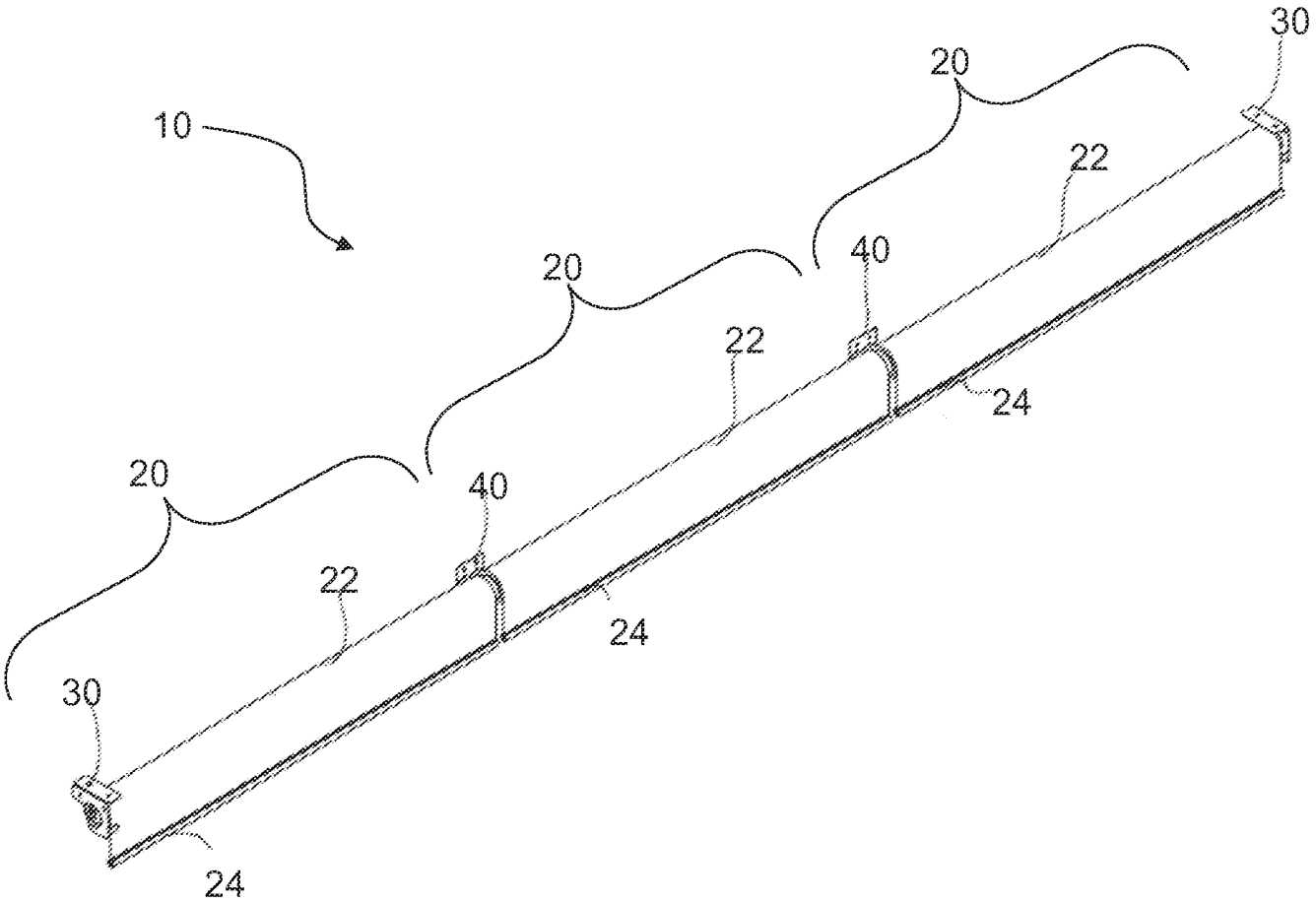
FIG. 1 is a perspective view of a system of linked shade assemblies, in accordance with certain aspects of the present invention.

The invention will now be described with reference to the drawing figures, in which like reference numerals refer to like parts throughout.

Various aspects of a system for mechanically operating a group of shades or blinds may be illustrated by describing components that are coupled, attached, and/or joined together. As used herein, the terms "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of a shade assembly in addition to the orientation depicted in the drawings. By way of example, if aspects of a shade assembly shown in the drawings are turned over, elements described as being on the "bottom" side of the other elements would then be oriented on the "top" side of the other elements. The term "bottom" can therefore encompass both an orientation of "bottom" and "top" depending on the particular orientation of the apparatus.

Various aspects of a shade assembly may be illustrated with reference to one or more exemplary embodiments. As used herein, the term "exemplary" means "serving as an example, instance, or illustration," and should not necessarily be construed as preferred or advantageous over other embodiments of the shade assembly disclosed herein. Moreover, although the term "shade" may be used alone or in combination with other descriptive terms when discussing various aspects of the present invention, it should be understood that the term, as used herein, encompasses other categories of window treatments, such as blinds or awnings, for example, as would be clearly understood by one of ordinary skill in the art.

As shown in FIG. 1, a shade system 10 may include multiple individual shade assemblies 20 arranged consecutively, each shade assembly 20 having a roll shade 22 that can be extended or retracted to cover, for example, a portion or the entirety of one or more windows, doors, etc. Each roll shade 22 may be provided with a bottom bar 24 for maintaining tension in the roll shade 22 during operation or use, while also providing a convenient hand hold for manual operation of the shade assembly 20. In accordance with another aspect of the present invention, the bottom bar 24 may provide an end-of-travel stop for the shade assembly 20 during retraction of roll shade 22.

Figure 2:
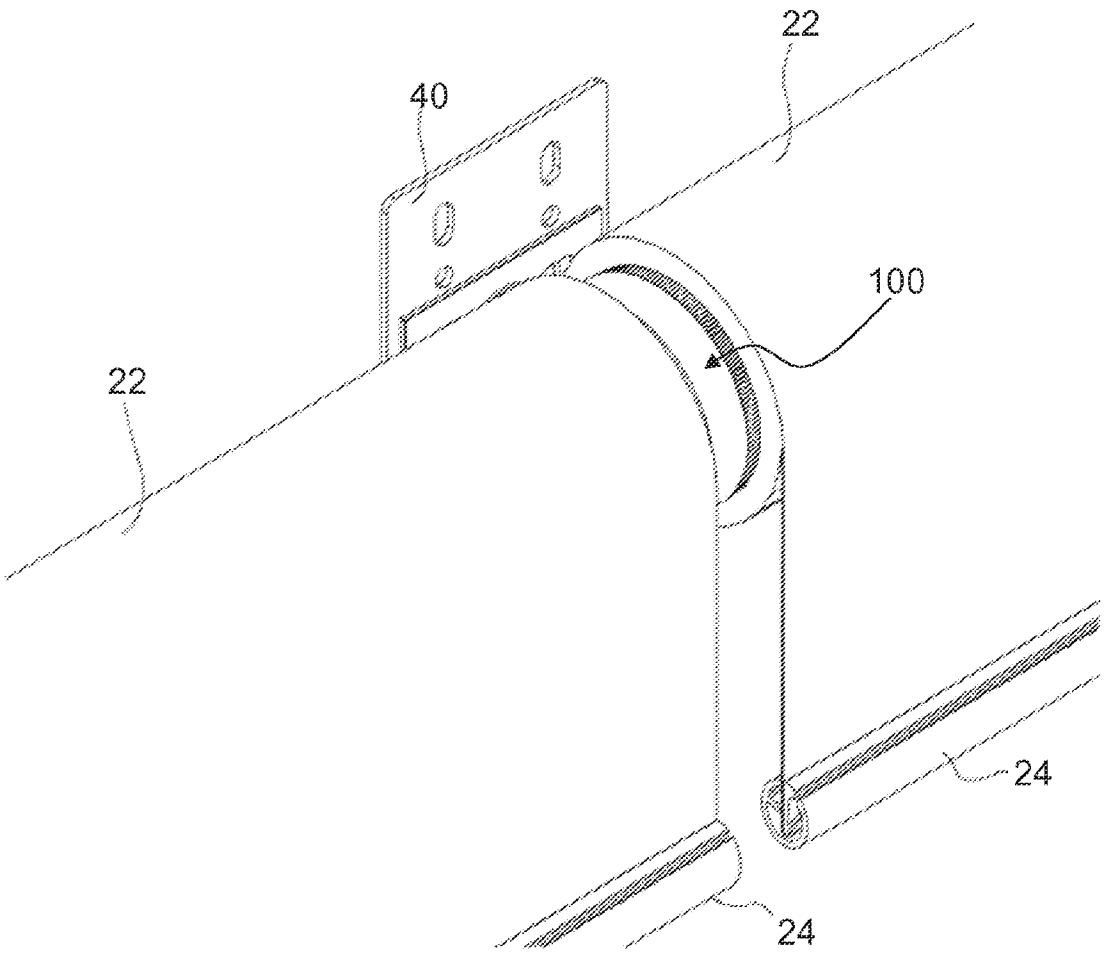
FIG. 2 is an enlarged perspective view of a connector assembly and mounting bracket, in accordance with certain aspects of the present invention.

The shade system 10 may be mounted to a wall or ceiling, for example, using end brackets 30 and one or more mounting brackets 40. As shown in FIGS. 1 and 2, an end bracket 30 may be provided at each exposed end of an outermost shade assembly 20 and a mounting bracket 40 may be provided for support and/or alignment at each internal junction of adjacent shade assemblies 20.

Figure 3:
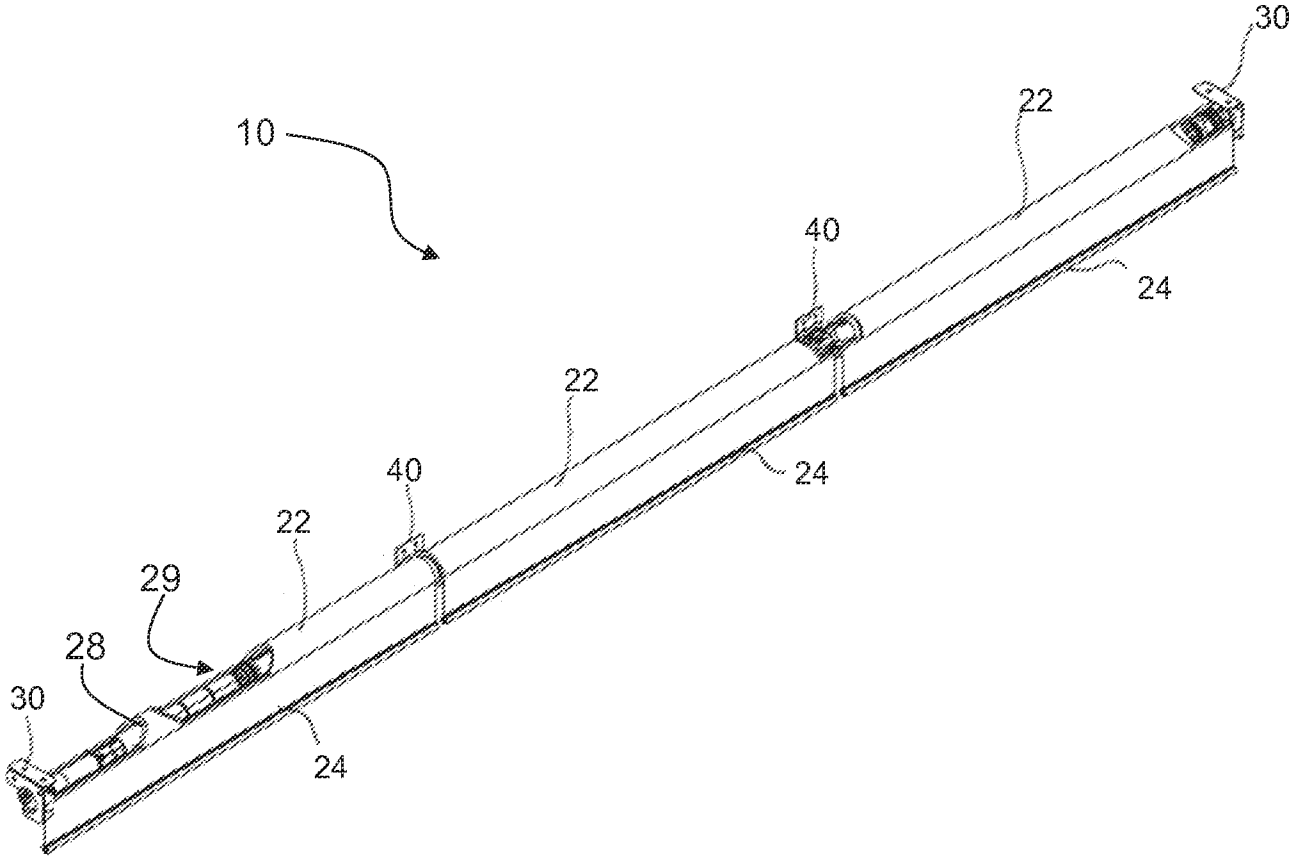
FIG. 3 is a perspective view of the assembly shown in FIG. 1 with areas of the tubular shade assembly exposed to show the arrangement of a counterbalance system, a power supply assembly, a motor assembly, and motor controls with an RF receiver assembly for a motorized shade assembly, in accordance with certain aspects of the present invention.
Figure 4:
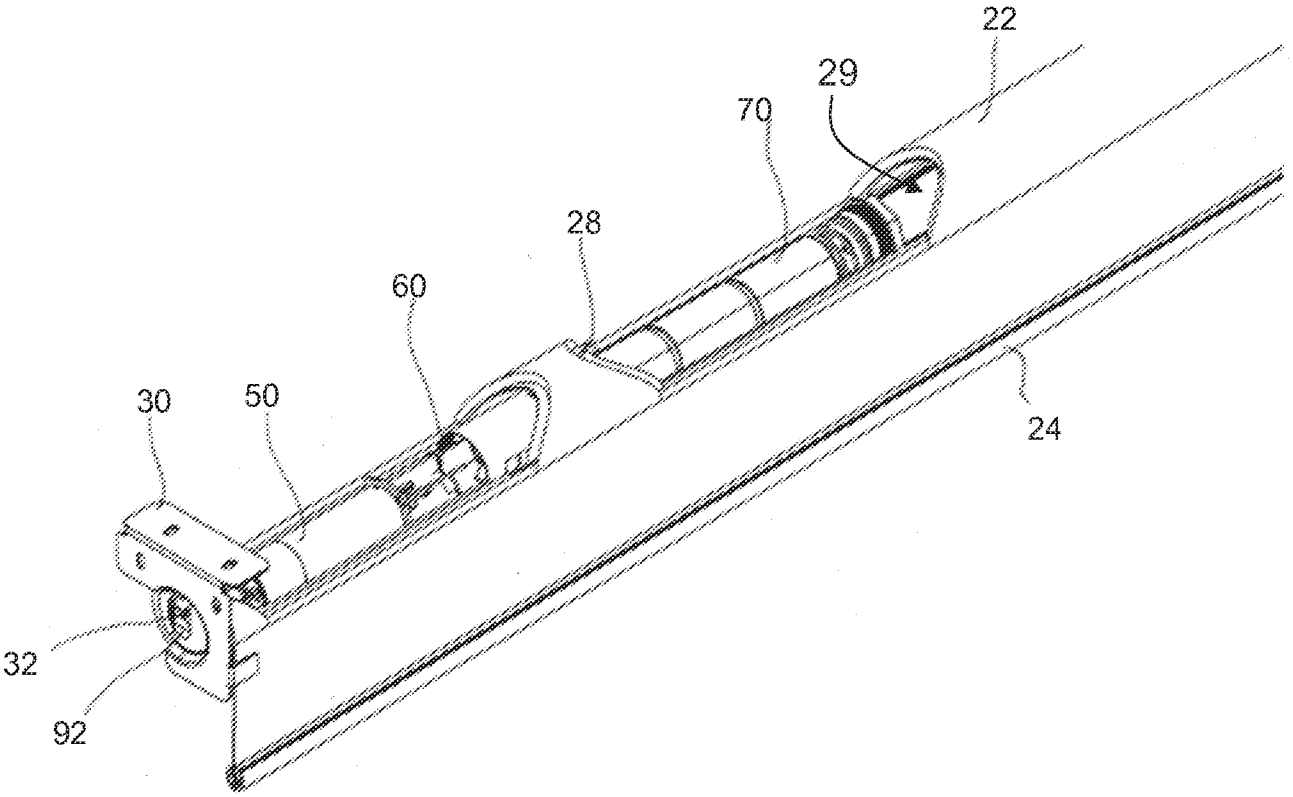
FIG. 4 is an enlarged portion of the motorized shade assembly shown in FIG. 4 to illustrate a location of the motor assembly, the power supply assembly, and the motor controls with the RF receiver assembly, in accordance with certain aspects of the present invention.

As shown in FIGS. 3-4, each shade assembly 20 includes a shade tube 28, which is a hollow cylindrical tube extending laterally substantially the entire width of the shade assembly 20. A top portion of the roll shade 22 may be secured to or around the shade tube 28 so that the roll shade 22 spools onto or off of the shade tube 28 depending upon the respective direction of rotation of the shade tube 28. The shade tube 28 defines an inner cavity 29, which may provide a mounting surface and housing for mounting hardware used to mount the shade assembly 20 to the brackets 30 and 40, as well as for alternative system components, including, for example, a motor assembly 50, a motor controller and radio frequency (RF) receiver assembly 60, a power supply assembly 70, and/or a counterbalance system 80 (see FIG. 7).

Figure 5:
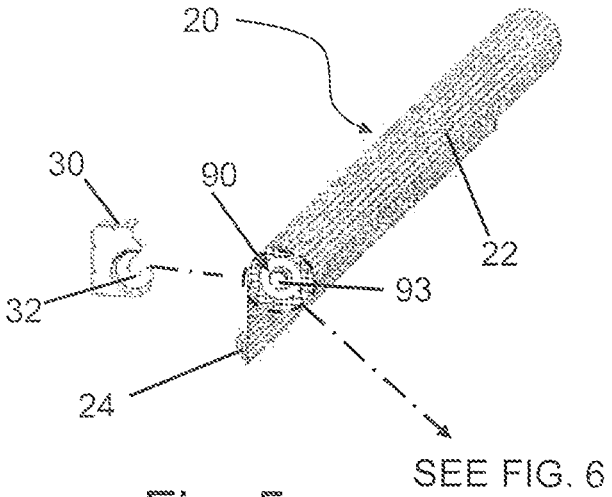
FIG. 5 is a perspective view of a shade assembly illustrating an end bracket connection, in accordance with certain aspects of the present invention.
Figure 6:
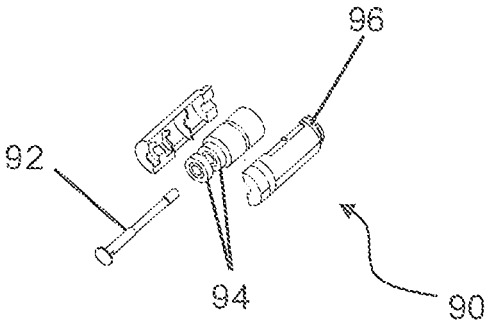
FIG. 6 is a perspective view of a support shaft assembly for mounting to the end bracket shown in FIG. 5, in accordance with certain aspects of the present invention.

The end bracket 30 may be used to mount and support a free end of a shade assembly 20. In accordance with certain aspects of the present invention, as shown in FIGS. 5 and 6, a support shaft assembly 90 may be provided at the free end of the shade assembly 20. The support shaft assembly 90 may include a support shaft 92 supported by one or more low-friction bearing elements 94 in a bearing housing 96. The bearing housing 96 may be press fit into the inner cavity 29 and/or otherwise mechanically coupled to an inner surface of the shade tube 28. For example, several raised longitudinal protrusions may be provided on an outside portion of the bearing housing 96 to mate in a keyed fashion with cooperating longitudinal recesses on an inner surface of the shade tube 28. A retention mechanism, such as a retention head 93 on support shaft 92 that cooperates with an opening 32 in the end bracket 30, is provided for positioning and securing the free end of the grouped shade system 10 in the end bracket 30.

Figure 7:
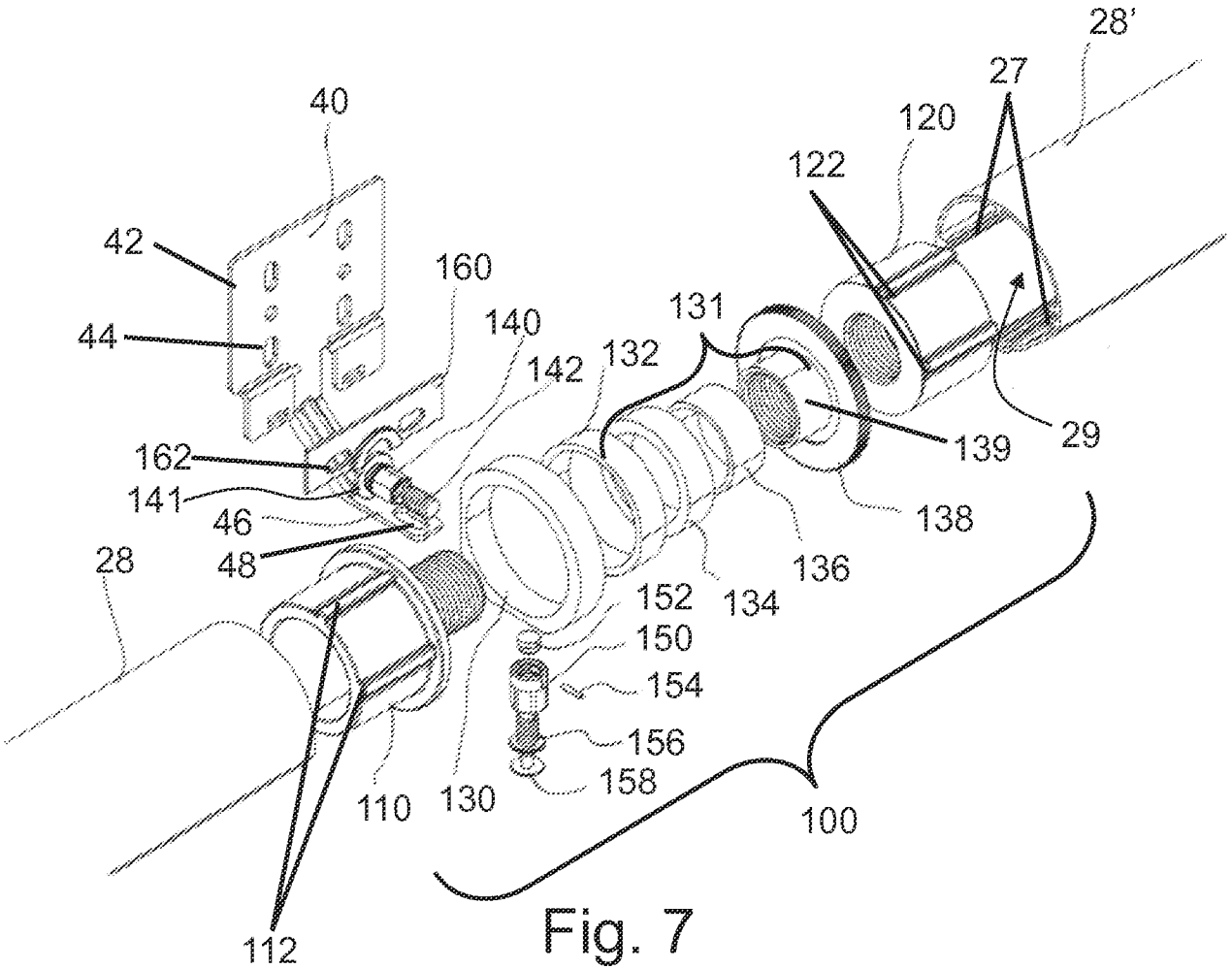
FIG. 7 is an exploded view illustrating various components of a linked shade system, in accordance with certain aspects of the present invention.

Adjacent shade assemblies 20 may be effectively linked in series by a connector assembly 100 as shown in FIG. 7. The connector assembly 100 includes a first coupling unit 110, which may be a male fitting having a threaded extension, and a second coupling unit 120, which may be a female fitting having an internally threaded orifice for receiving the threaded extension of the male fitting. The first coupling unit 110 may be inserted into an end of a first shade tube 28 that is or will be placed adjacent to a second shade tube 28, and the second coupling unit 120 may be inserted into an end of the second shade tube 28 that is or will be placed adjacent to the end of the first shade tube 28 having the first coupling unit 110 installed. In accordance with aspects of the present invention, the coupling units 110 and 120 may be provided with several raised longitudinal protrusions, 112 and 122, respectively, to cooperate with longitudinal recesses 27 on inner surfaces of the first and second shade tubes 28 for securing the coupling units 110 and 120 to the first and second shade tubes 28 in a fixed rotational relationship.

A bearing assembly 131 that includes an outer race 132, a spacer ring 134 and bearing elements 136 may be positioned between the first coupling unit 110 and an adjustment ring 138. In accordance with aspects of the present invention, an extended portion 139 of the adjustment ring 138 may serve as the inner race for the bearing assembly 131 or a separate inner race component may be provided that is mounted onto the extended portion 139 of the adjustment ring 138. The adjustment ring 138 may be internally threaded, for example, to adjustably mate with the first coupling unit 110 in order to securely position the bearing assembly 131 between the adjustment ring 138 and the first coupling unit 110. A locating ring 130 may be concentrically seated around the bearing assembly 131 for mounting the connector assembly 100 to the mounting bracket 40 with the connected shade tubes 28 and 28' rotatably supported by the bearing assembly 131. The extended portion 139 of the adjustment ring 138 may be wider than the outer race 132 and the locating ring 130 such that the adjustment ring 138 will not bind the bearing assembly 131 or the locating ring 130 when mated with the first coupling unit 110.

The adjustment ring 138, supporting the bearing assembly 131 and the locating ring 130, may be mounted onto the first coupling unit 110 so that the male end portion of the first coupling unit 110 extends all the way through the first coupling unit 110. The second coupling unit 120 may then be mated to the first coupling unit 110, such as by screwing the threaded end of the male fitting into the internally threaded receiving orifice of the female fitting, until the two shade tubes 28 are matched rotationally to have each of the shades 22 hanging evenly. Once rotationally aligned, the adjustment ring 138 may be tightened to secure the assembly and ensure that the adjacent shades 22 will move in unison. With the connector assembly 100 linking adjacent assemblies 20, a rotational torque applied to one shade tube 28 may be effectively transferred to an adjacent shade tube 28 via the bearing assembly 131 supported by the locating ring 130 and the mounting bracket 40.

The mounting bracket 40 may be formed with a mounting plate 42 and an extended arm 46. In accordance with yet other aspects of the present invention, to further assist in decreasing any misalignment of the two mounted shade assemblies, due to irregular mounting surfaces, for example, the connector assembly 100 may be provided with one or more axis adjusting nuts. The first adjustment nut 140 adjusts alignment along a first axis substantially orthogonal to a central longitudinal axis through the linked shade assemblies 20. The first adjustment nut 140 may be mounted via an adjustable bracket 160 and may be aligned with the locating ring 130 through adjustment of the position of slots 162 in the adjustable bracket 160 with respect to a series of slots 44 provided in the mounting plate 42 of the mounting bracket 40. The adjustable bracket 160 configured so that when mounted to the mounting bracket 40 the first adjustment nut 140 may be positioned with a head portion 141 secured in a pocket formed between the adjustable bracket 160 and the mounting bracket 40. The adjustment nut 140 is thus retained from axial movement with respect to the bracket 40 while retaining the ability to rotate.

The adjustment nut 140 may be configured to receive a threaded shaft 142 connected to the locating ring 130. Although shown in FIG. 7 separate from the locating ring 130, the threaded shaft 142 may be integrally formed with the locating ring 130. Because the adjustment nut 140 is restrained from axial movement, adjustment of the first adjustment nut 140 results in the threaded shaft 142 being extended or withdrawn from the receiving portion of the adjustment nut 140. The locating ring 130 connected to the threaded shaft 142 may thus be adjusted axially along the first axis until the first and second shade tubes 28 are in a position of alignment with respect to the first axis.

The second adjustment nut 150 adjusts alignment along a second axis substantially orthogonal to both the first axis and the central longitudinal axis through the linked shade assemblies 20. A contact pad 152 may be configured to extend from the locating ring 130. Although shown in FIG. 7 separate from the locating ring 130, the contact pad 152 may be integrally formed with the locating ring 130. The contact pad 152 may be rotatably secured in a receiving portion of the second adjustment nut 150 by a retaining pin 154. For example, the contact pad 152 may have a peripheral groove for receiving an end of the retaining pin 154 so that the adjustment nut 150 is rotatably secured to the locating ring 130 directly adjacent or abutting the locating ring 130. A threaded bolt 156 may be mounted via a positioning slot 48 on the extended arm 46 of the mounting bracket 40 and held in position by a retaining screw 158. Turning the second adjustment nut 150 moves the nut axially along the axis of the threaded bolt 156 toward or away from the extended arm 46 to achieve alignment along the second axis.

The mounting of the connector assembly 100 to the mounting bracket 40 by virtue of the adjustment nuts 140 and 150, as described above, provides for multidimensional adjustment allowing precise alignment of adjacent shade assemblies 20 while providing significant structural support at a critical juncture of the shade system 10. Precise axial alignment of the shade assemblies 20 significantly increases the efficiency of transferring a generated torque across the entire system 10 while reducing the parasitic power loss that is a problem with conventional mechanically linked shade systems. The connector assembly 100 and mounting bracket 40 combination may be capable of supporting various loads, including, for example, at least 55 pounds.

Figure 8:
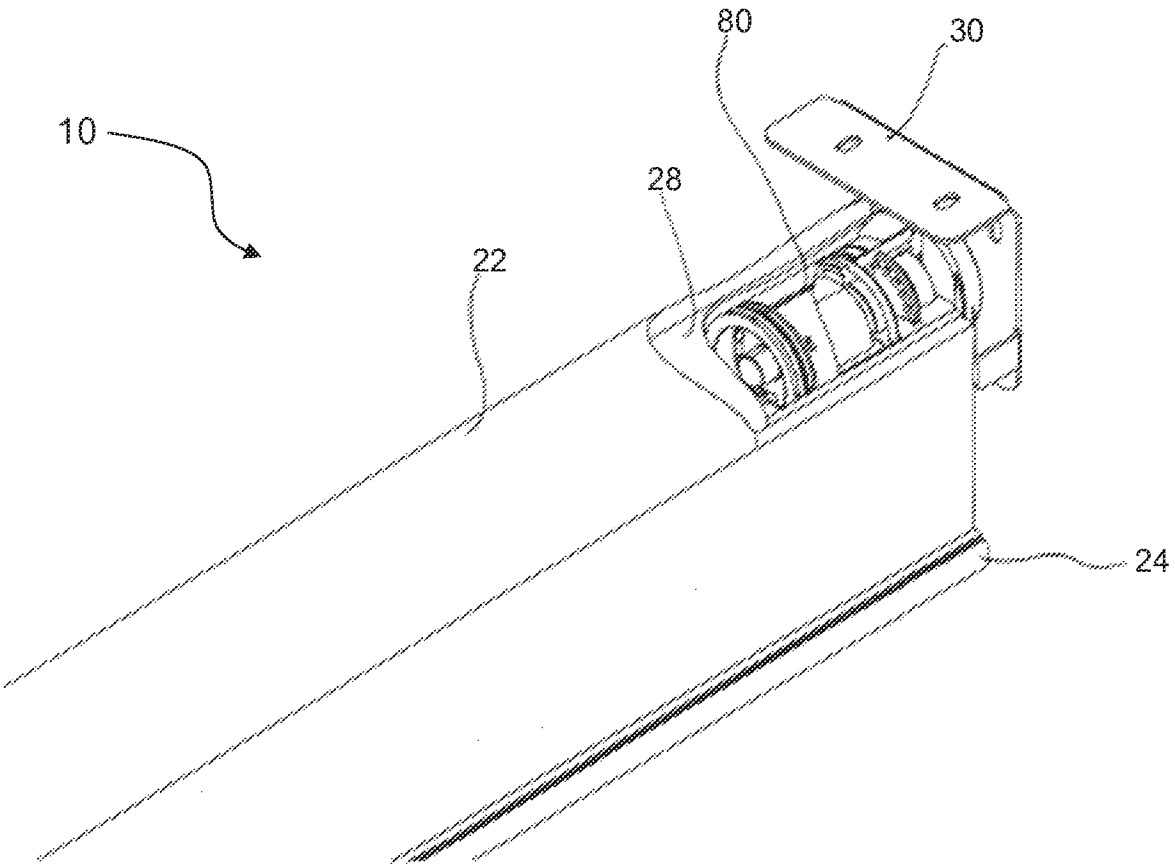
FIG. 8 is an enlarged portion of the motorized shade assembly shown in FIG. 3 to illustrate a location of the counterbalance system, in accordance with certain aspects of the present invention.

FIG. 8 illustrates placement of the counterbalance system 80 toward one end of the grouped shade system 10. With respect to a manually operated group of shades, the counterbalance system 80, which may be a flat spring system as shown, or include torsion springs and/or other biasing members, provides a retraction capability for the shade 22 when manually actuated. The counterbalance system 80 is preferably located at or toward the end of the shade assembly 20 or has means to transmit a torque from the biasing member location to the linked structure in order to realize a sufficient torsional differential.

Referring back to FIGS. 3 and 4, with respect to a motorized group of shades, the motor assembly 50 and motor controller with the RF receiver assembly 60 may be configured to be positioned in the inner cavity 29 of a shade tube 28 at or toward the end of a shade tube 28 that will be mounted on an end bracket 30. For this motorized configuration, the counterbalance system 80, including the counterbalance springs, may be positioned in the inner cavity 29 at or toward the end of the shade tube 28 that will be mounted to the other end bracket 30 at the opposite end of the shade system 10 from the end having the motor assembly 50. As shown in FIG. 8, arranging the counterbalance system 80 at or toward an end of the shade assembly 20 that defines an end of the shade system 10 provides the sufficient torsional differentials mentioned above.

Figure 9:
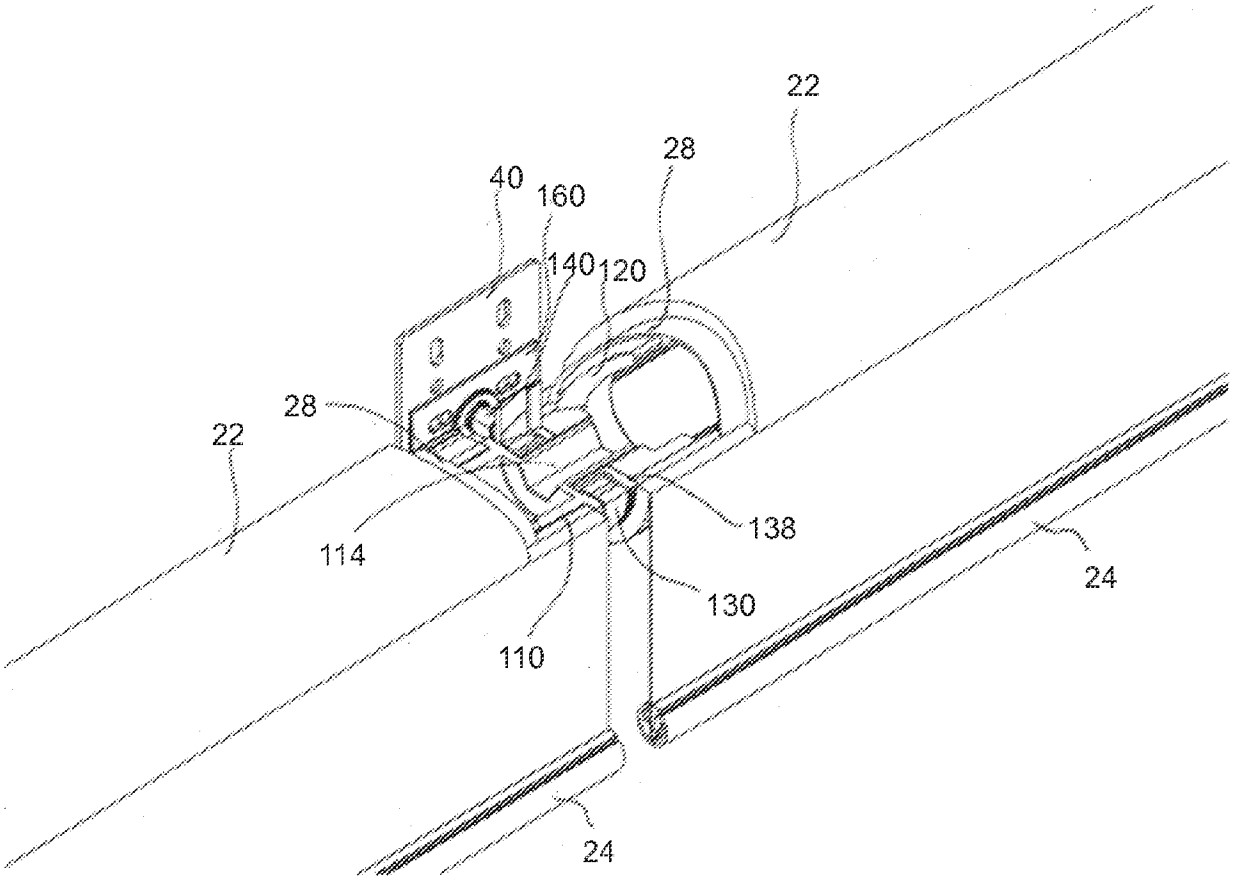
FIG. 9 is an enlarged portion of the motorized shade assembly shown in FIG. 3 to illustrate components of a connector assembly and mounting bracket, in accordance with certain aspects of the present invention.

The power supply assembly 70 shown in FIG. 4 may be provided in any of the shade tubes 28 in the linked group of shade assemblies 20. Power may be provided from the power supply assembly 70 to assemblies positioned in other linked shade assemblies 20, such as the motor assembly 50 and motor controller with the RF receiver assembly 60, by running a wire from the power supply assembly 70 through an opening 114 in the male fitting 21, as shown in FIG. 9. Accordingly, in accordance with aspects of the present invention, a shade system 10 of linked shade assemblies 20 may be configured to have the primary subsystems, such as the motor assembly 50, the motor controller with the RF receiver assembly 60, the power supply assembly 70, and/or the counterbalance system 80, distributed across the various shade tubes 28, rather than having to provide each subsystem in every shade tube 28.

For example, in a shade system 10 of three linked shade assemblies 20, as shown in FIG. 1, the motor assembly 50 and motor controller with the RF receiver assembly 60 may be provided in either of the end shade assemblies 20, the power supply assembly 70 may be provided in the middle shade assembly 20, and the counterbalance system 80 may be provided in the other of the end shade assemblies 20 not containing the motor assembly 50. Reducing and distributing the weight allows for installation of a shade system 10 of linked shade assemblies 20 capable of efficiently opening and closing a group of shades 22 in unison. Furthermore, the mounting brackets 40 and connector assembly 100 with locating ring 130 provide precision control over junction alignment to easily and effectively align in multiple dimensions the individual shade assemblies 20, increasing the efficiency of transferring a generated torque across the entire system 10 while reducing the parasitic power loss that is a problem with conventional mechanically linked shade systems.

Figure 11:
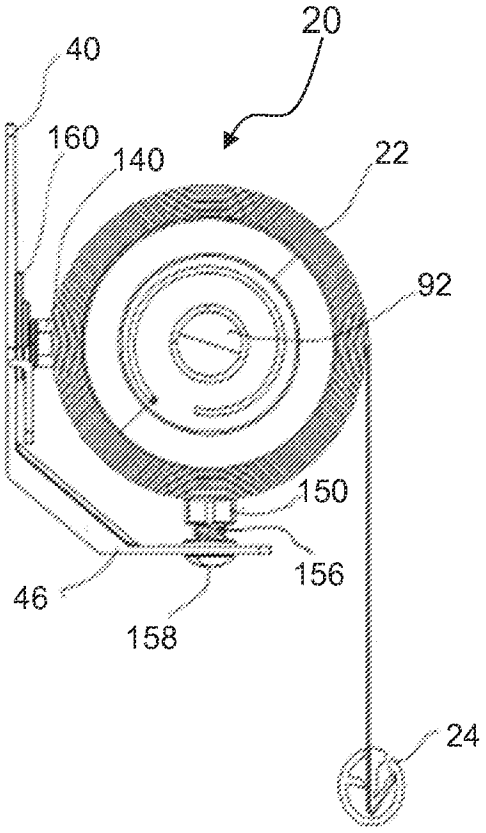
FIG. 11 is a side view of the shade bracket assembly shown in FIG. 8, except with the shade material, in accordance with certain aspects of the present invention.
Figure 10:
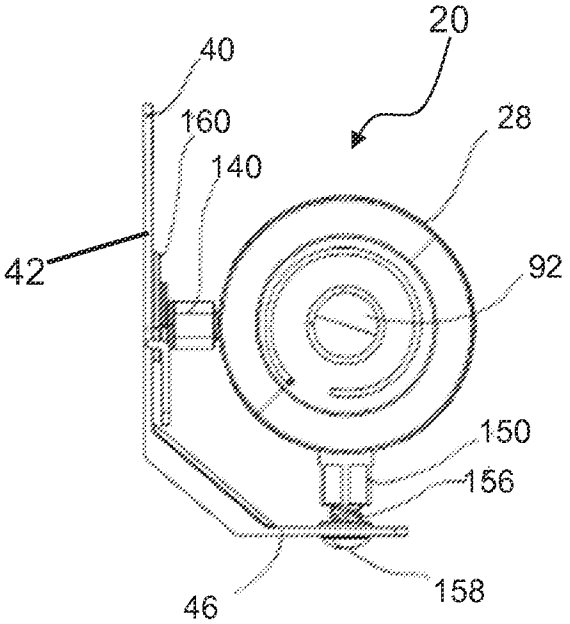
FIG. 10 is a side view of a shade bracket assembly without the shade material and in a wall mount position, in accordance with certain aspects of the present invention.

FIGS. 10-15 illustrate various configurations for arranging the mounting bracket 40 in a shade system 10 of multiple shade assemblies 20. As shown in FIGS. 10 and 11, the mounting bracket 40 may be mounted with the mounting plate 42 substantially flush with a vertical structure, such as a wall, and the extended arm 46 substantially below the connector assembly 100 (see also FIGS. 7 and 9). The extended arm 46, in combination with the rather compact nature of the connector assembly 100, permits adjacent shade assemblies 20 to be connected with a minimal gap between the shades 22.

Figure 13:
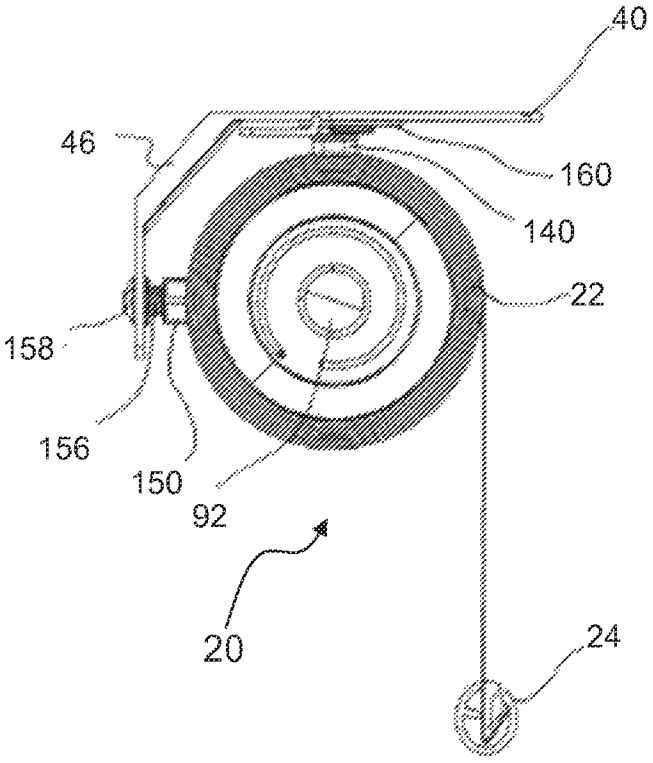
FIG. 13 is a side view of the shade bracket assembly shown in FIG. 10, except with the shade material, in accordance with certain aspects of the present invention.
Figure 12:
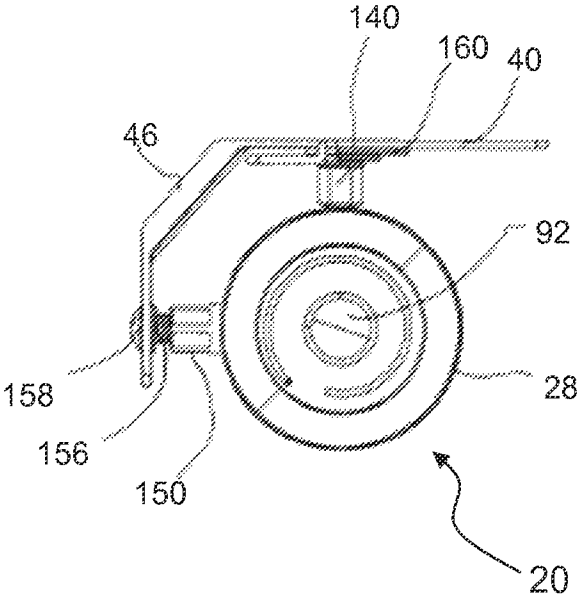
FIG. 12 is a side view of a shade bracket assembly without the shade material and in a ceiling mount position, in accordance with certain aspects of the present invention.

As shown in FIGS. 12 and 13, the mounting bracket 40 may alternatively be mounted with the mounting plate 42 substantially flush with a horizontal structure, such as a ceiling or overhang, and the extended arm 46 substantially to one side of the connector assembly 100.

Figure 15:
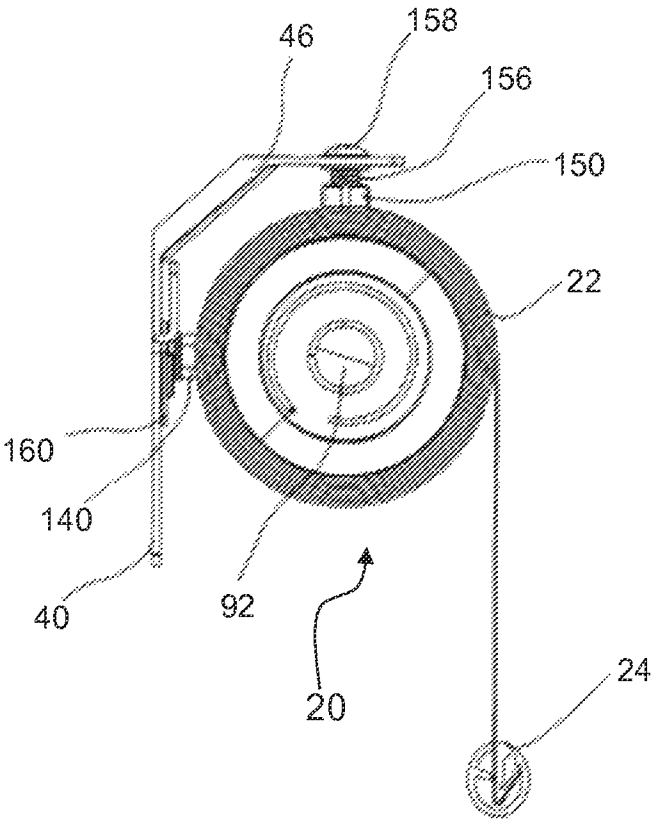
FIG. 15 is a side view of the shade bracket assembly shown in FIG. 12, except with the shade material, in accordance with certain aspects of the present invention.
Figure 14:
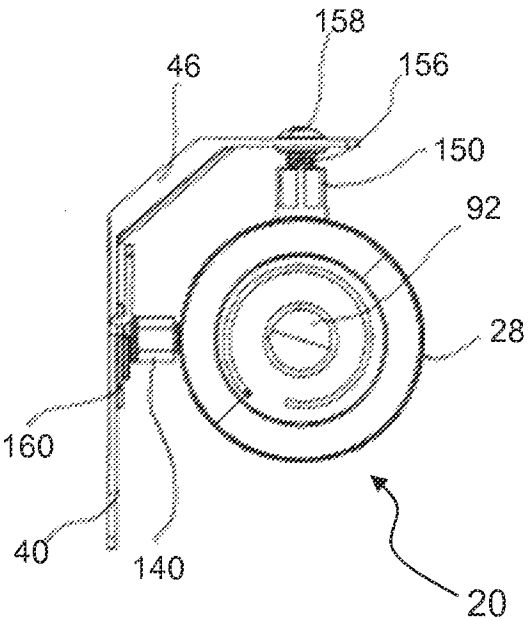
FIG. 14 is a side view of a shade bracket assembly without the shade material and in a second wall mount position, in accordance with certain aspects of the present invention.

FIGS. 14 and 15 illustrate a second wall mounting position in accordance with certain aspects of the present invention, the mounting bracket 40 being mounted with the mounting plate 42 substantially flush with a vertical structure, such as a wall, and the extended arm 46 substantially above the connector assembly 100.

Figure 16:
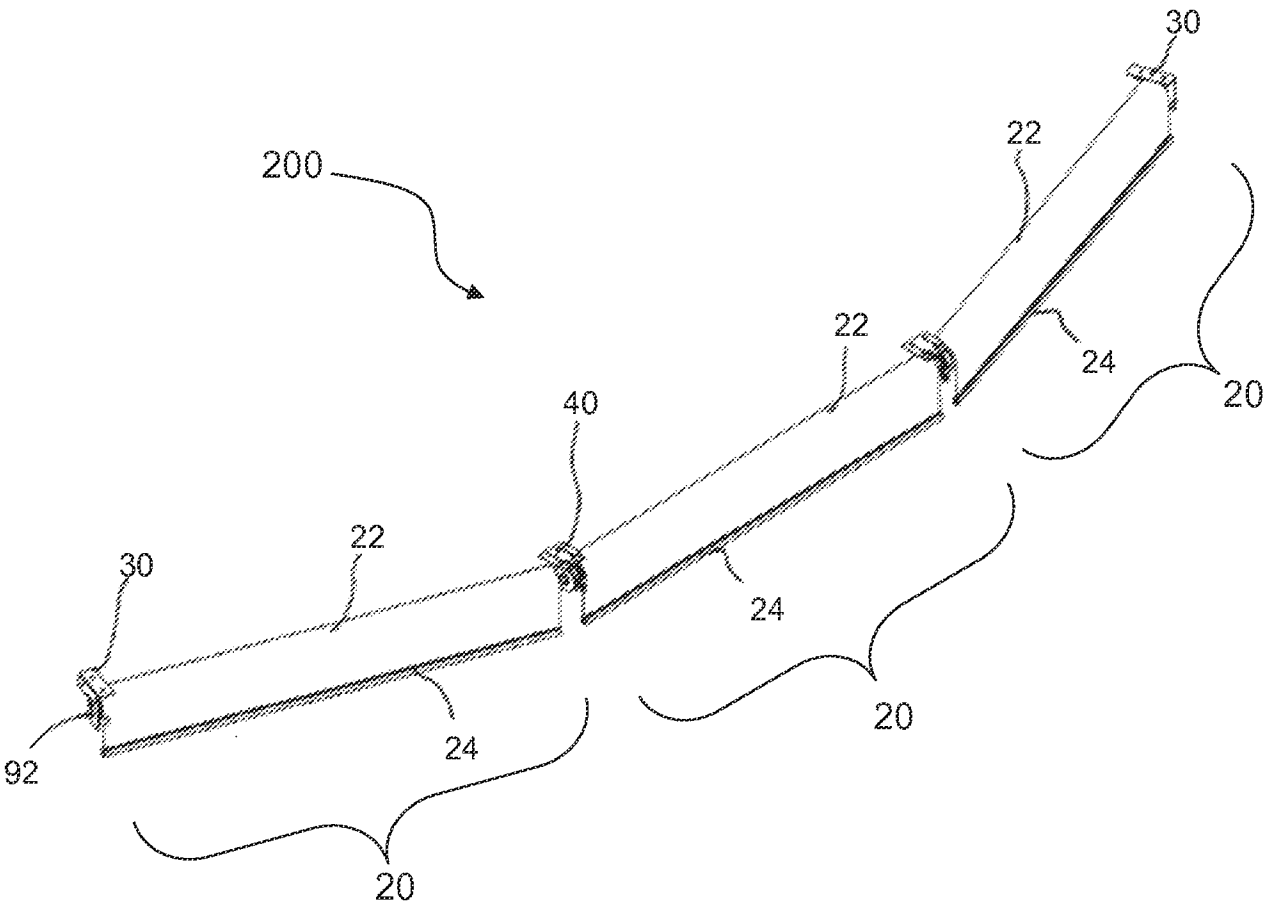
FIG. 16 is a perspective view of an angle mounting arrangement of shade assemblies, such as over a bay window, in accordance with certain aspects of the present invention.
Figure 17:
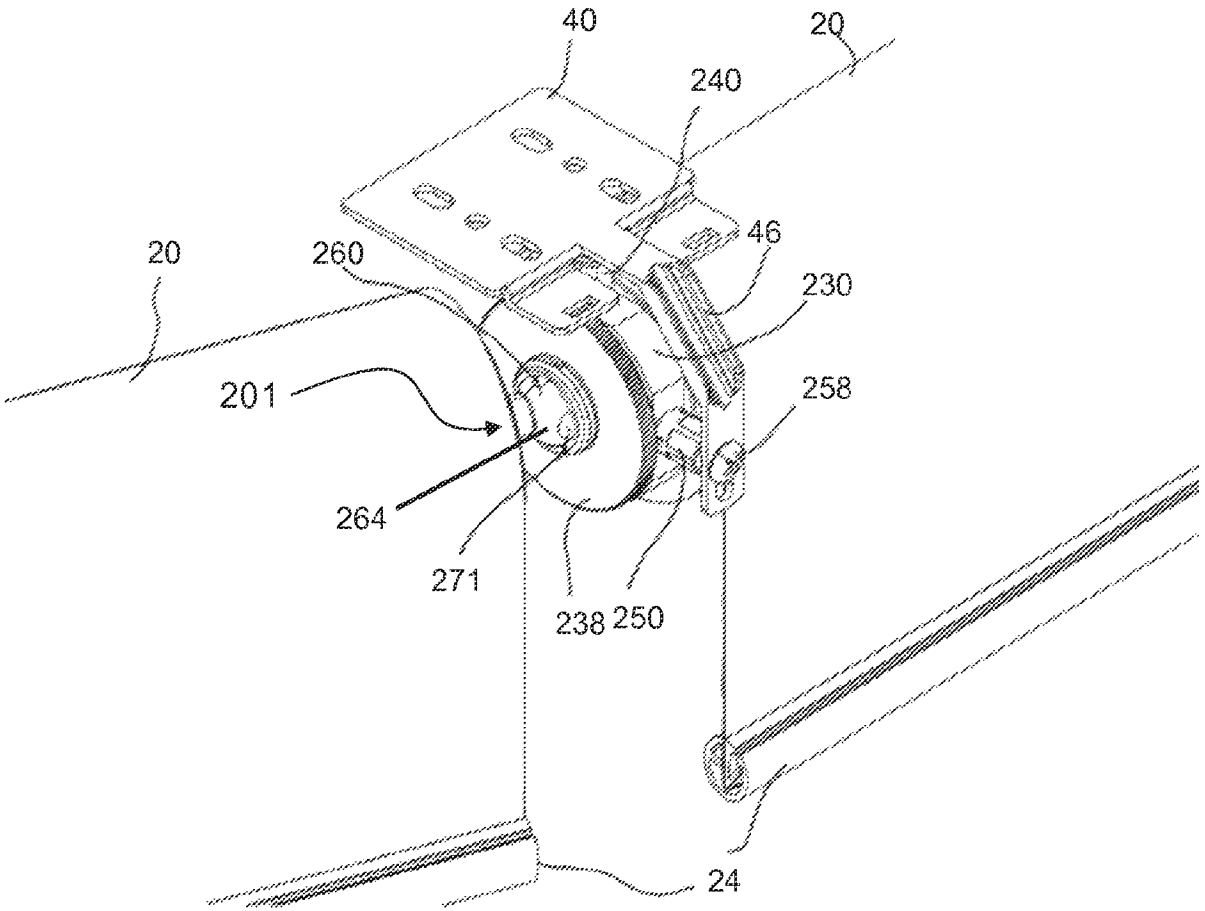
FIG. 17 is an enlarged view of the shade to shade connection shown in FIG. 16, in accordance with certain aspects of the present invention.
Figure 18:
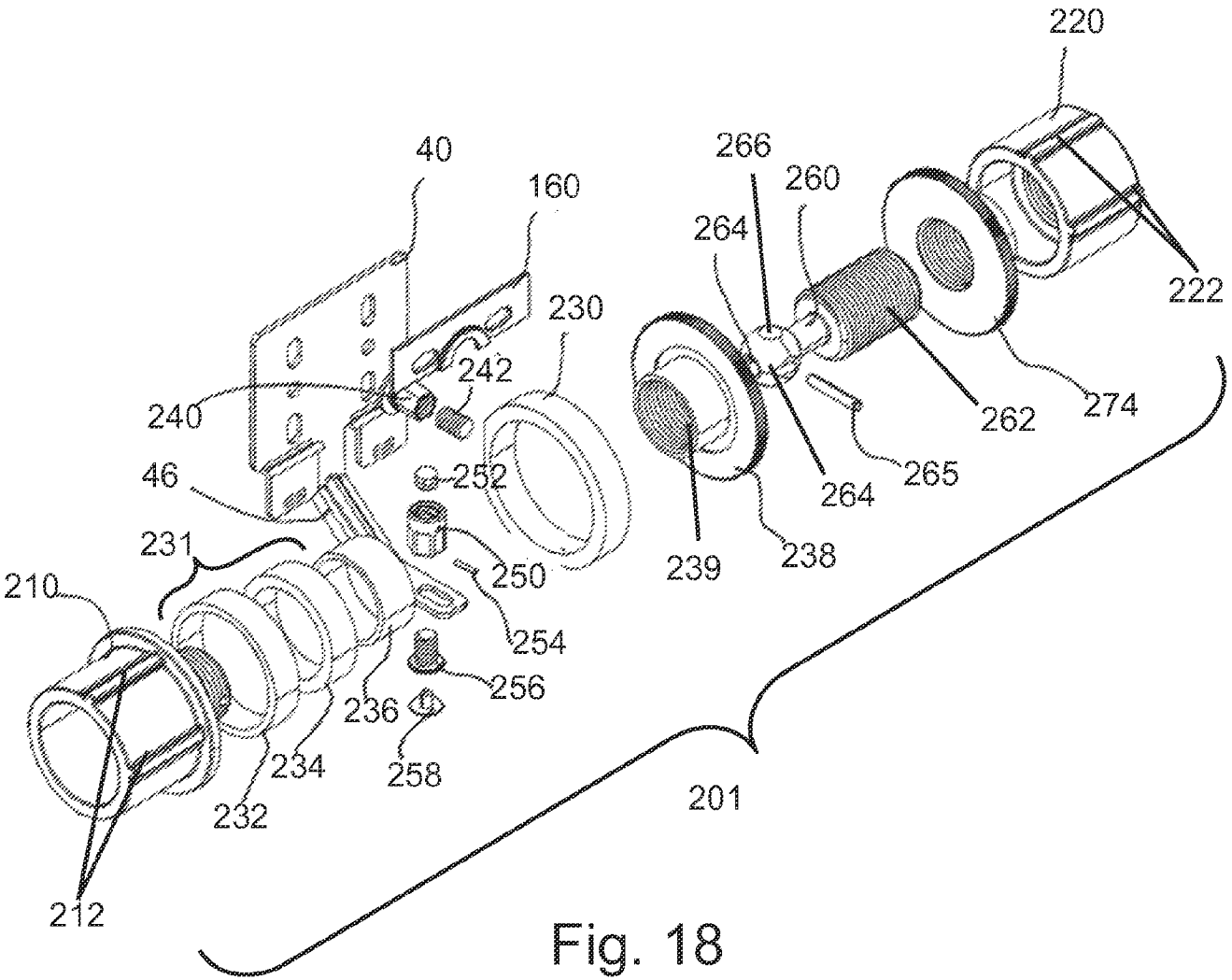
FIG. 18 is an exploded view of components of the shade to shade connection shown in FIG. 17, in accordance with certain aspects of the present invention.

In accordance with yet other aspects of the present invention, FIGS. 16-18 depict a shade system 200 having a series of shade assemblies 20 linked together at angled intervals, rather than an in-line arrangement as described previously. An angular arrangement of linked shade assemblies 20 may be used to provide uniform extension and/or retraction of a series of shades 22 at a location where one or more doors and/or windows are angularly arranged, such as a bay window, for example. A mounting bracket 40, as described above, may be located at each angular junction of adjacent shade assemblies 20. Each mounting bracket 40 may cooperate with the adjustment nuts 240 and 250, as well as the same or similar mounting hardware for support and alignment as described above, including, for example, a locating ring 230 and a bearing assembly.

As shown more particularly in FIGS. 17 and 18, adjacent shade assemblies 20 may be effectively linked at angular intervals by an articulating connector assembly 201. The connector assembly 201 includes a first coupling unit 210, which may be a male fitting having a threaded extension, and a second coupling unit 220, which may be a female fitting having an internally threaded orifice for receiving the threaded extension of the male fitting. The first coupling unit 210 may be inserted into an end of a first shade tube 28 that is or will be placed adjacent to a second shade tube 28, and the second coupling unit 220 may be inserted into an end of the second shade tube 28 that is or will be placed adjacent to the end of the first shade tube 28 having the first coupling unit 210 installed. In accordance with aspects of the present invention, the coupling units 210 and 220 may be provided with several raised longitudinal protrusions, 212 and 222, respectively, to cooperate with longitudinal recesses on inner surfaces of the first and second shade tubes 28 for securing the coupling units 210 and 220 to the first and second shade tubes 28 in a fixed rotational relationship.

A bearing assembly 231 that includes an outer race 232, a spacer ring 234 and bearing elements 236 may be positioned between the first coupling unit 210 and an adjustment ring 238. In accordance with aspects of the present invention, an extended portion 239 of the adjustment ring 238 may serve as the inner race for the bearing assembly 231 or a separate inner race component may be provided that mounts onto the extended portion 239 of the adjustment ring 238. The adjustment ring 238 may be internally threaded, for example, to adjustably mate with the first coupling unit 210 in order to securely position the bearing assembly 231 between the adjustment ring 238 and the first coupling unit 210. A locating ring 230 may be concentrically seated around the bearing assembly 231 for mounting the connector assembly 201 to the mounting bracket 40 with the connected shade tubes 28 and 28' rotatably supported by the bearing assembly 231. The extended portion 239 of the adjustment ring 238 may be wider than the outer race 232 and the locating ring 230 such that the adjustment ring 238 will not bind the bearing assembly 231 or the locating ring 230 when mated with the first coupling unit 210.

The mounting bracket 40 may be formed with a mounting plate 42 and an extended arm 46. In accordance with yet other aspects of the present invention, to further assist in decreasing any misalignment of the two mounted shade assemblies, due to irregular mounting surfaces, for example, the connector assembly 201 may be provided with one or more axis adjusting nuts. The first adjustment nut 240 adjusts alignment along a first axis substantially orthogonal to a central longitudinal axis through the linked shade assemblies 20. The first adjustment nut 240 may be mounted via an adjustable bracket 160 and may be aligned with the locating ring 230 through adjustment of the position of slots 162 in the adjustable bracket 160 with respect to a series of slots 44 provided in the mounting plate 42 of the mounting bracket 40. The adjustable bracket 160 configured so that when mounted to the mounting bracket 40 the first adjustment nut 140 may be positioned with a head portion 141 secured in a pocket formed between the adjustable bracket 160 and the mounting bracket 40. The adjustment nut 140 is thus retained from axial movement with respect to the bracket 40 while retaining the ability to rotate.

The adjustment nut 240 may be configured to receive a threaded shaft 242 connected to the locating ring 230. Although shown in FIG. 18 separate from the locating ring 230, the threaded shaft 242 may be integrally formed with the locating ring 230. Because the adjustment nut 240 is restrained from axial movement, adjustment of the first adjustment nut 240 results in the threaded shaft 242 being extended or withdrawn from the receiving portion of the adjustment nut 240. The locating ring 230 connected to the threaded shaft 242 may thus be adjusted axially along the first axis until the first and second shade tubes 28 are in a position of alignment with respect to the first axis.

The second adjustment nut 250 adjusts alignment along a second axis substantially orthogonal to both the first axis and the central longitudinal axis through the linked shade assemblies 20. A contact pad 252 may be configured to extend from the locating ring 230. Although shown in FIG. 18 separate from the locating ring 230, the contact pad 252 may be integrally formed with the locating ring 230. The contact pad 252 may be rotatably secured in a receiving portion of the second adjustment nut 250 by a retaining pin 254. For example, the contact pad 252 may have a peripheral groove for receiving an end of the retaining pin 254 so that the adjustment nut 250 is rotatably secured to the locating ring 230 directly adjacent or abutting the locating ring 230. A threaded bolt 256 may be mounted via a positioning slot 48 on the extended arm 46 of the mounting bracket 40 and held in position by a retaining screw 258. Turning the second adjustment nut 250 moves the nut axially along the axis of the threaded bolt 256 toward or away from the extended arm 46 to achieve alignment along the second axis.

The adjustment ring 238, supporting the bearing assembly 231 and the locating ring 230, may be mounted onto the first coupling unit 210. A drive journal 260 is provided for support and the effective transfer of torque across an angular junction of two adjacent shade assemblies 20. The drive journal 260 may define a constant velocity joint, which minimizes the surging typically experienced with conventional universal joints. The drive journal 260 may include a threaded extension 262 for mating with the internally threaded orifice of the second coupling unit 220. A ball end 264 of the journal 260 may extend to mount in a socket 271 (see FIG. 17) internal to the distal threaded extension of the first coupling unit 210 and a drive pin 265 may be used to secure the ball end 264 to the first coupling unit 210 at an angle of between 1° and 89° offset, and preferably between 1° and 40° offset, from direct axially alignment when measured along the longitudinal axis of the adjacent assemblies 20. Referring again to FIG. 18, the ball end 264 of the journal 260 may also be formed with various flat surfaces 266. The internal surface of the hollow interior portion of the socket 271 formed in the first coupling unit 210 may be configured with corresponding flat surfaces for seating the flat surfaces 266 of the ball end 264. A second adjustment ring 274 may be provided between the drive journal 260 and the second coupling unit 220 for efficient lateral adjustment and securing of the journal 260.

The constant velocity joint thus establishes an effective angular connection between a first shade assembly 20 and an adjacent shade assembly 20 while permitting the adjacent assemblies 20 to rotate in unison. With the connector assembly 201 angularly linking adjacent shade assemblies 20, a rotational torque applied to one shade tube 28 may be effectively transferred to an adjacent shade tube 28. Once rotationally aligned, the adjustment rings 238 and 274, along with the adjustment nuts 240 and 250, may be adjusted to ensure proper alignment of the shade assemblies 20 for minimizing drag and associated power loss when in a motorized configuration.

Figure 19:
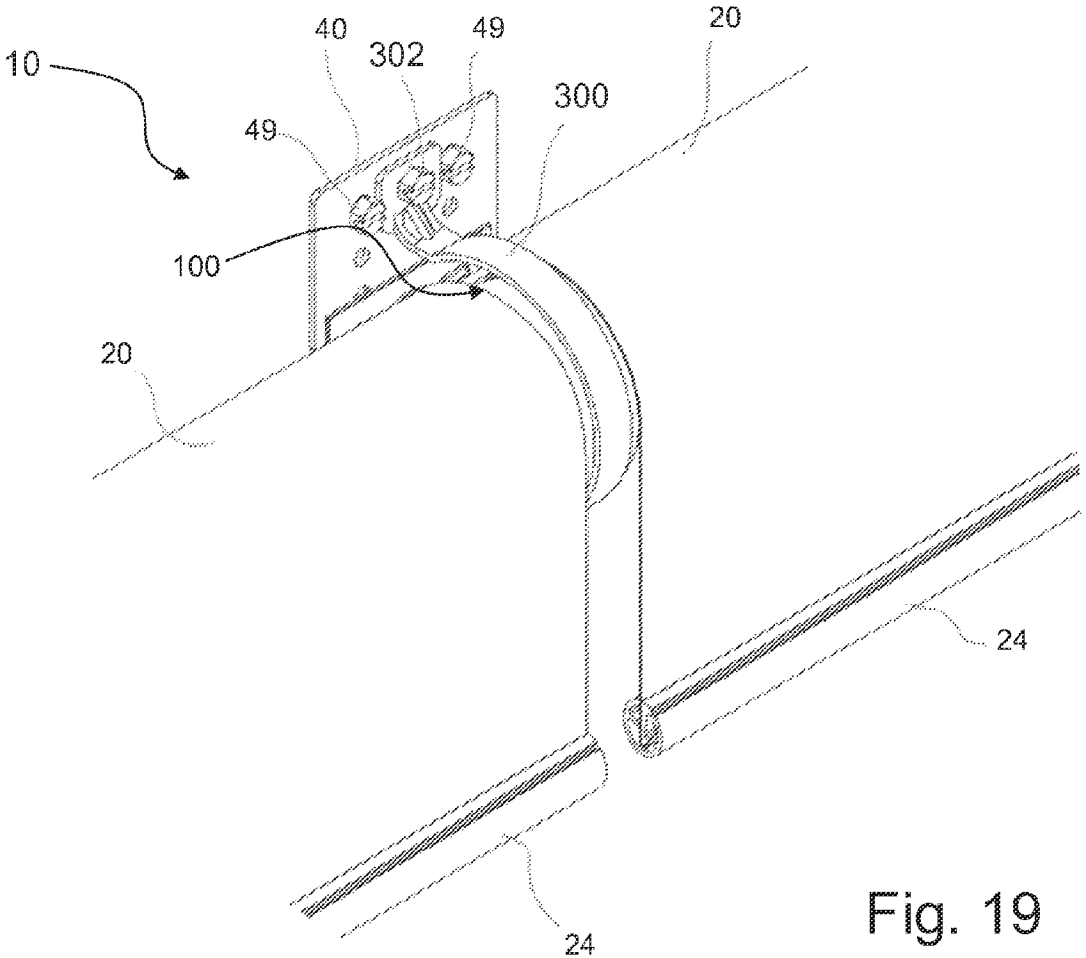
FIG. 19 is a perspective view of components of a shade assembly including a safety strap, in accordance with certain aspects of the present invention.
Figure 20:
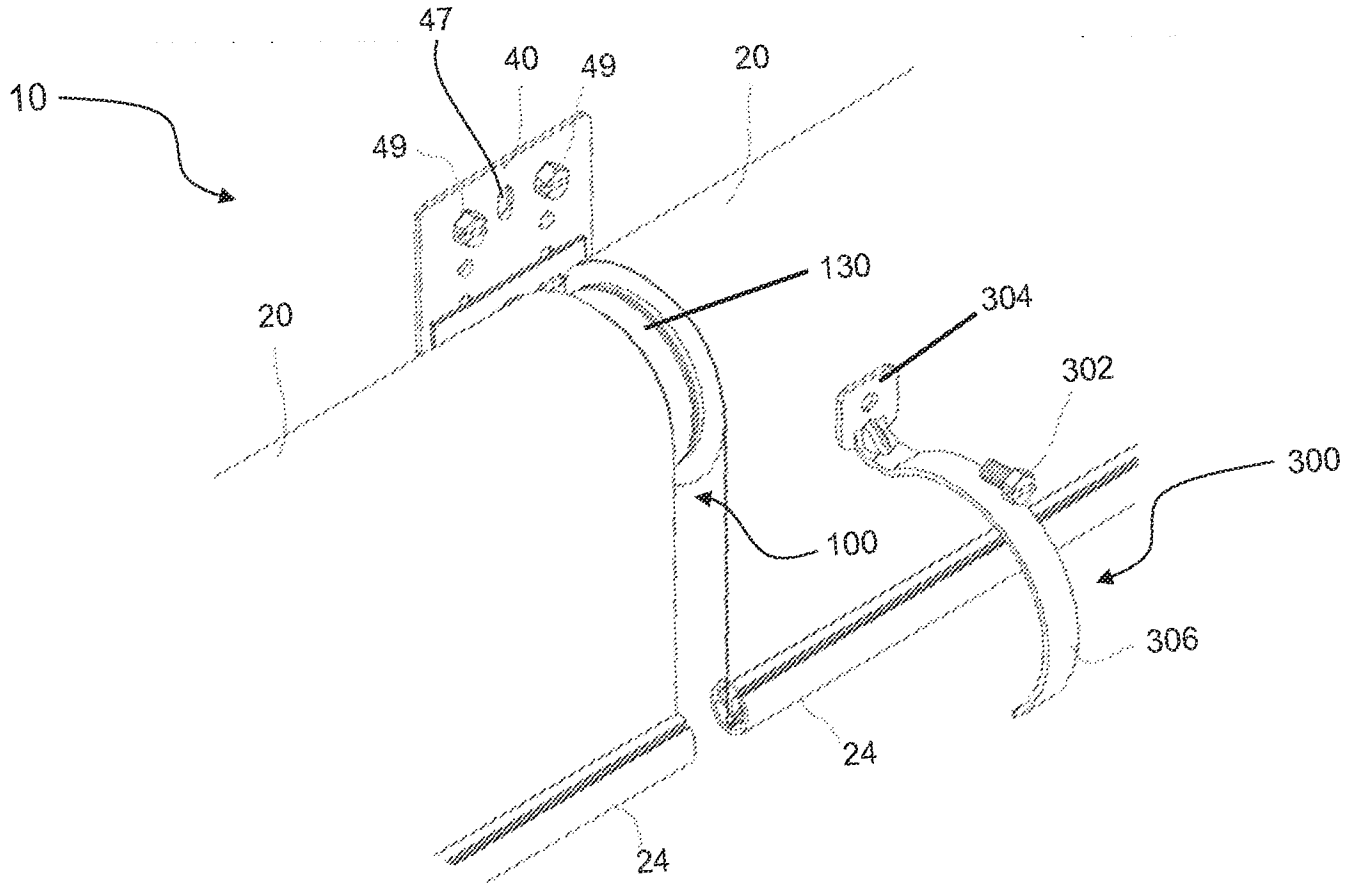
FIG. 20 is an exploded view the shade assembly with safety strap shown in FIG. 19, in accordance with certain aspects of the present invention.
Figure 21:
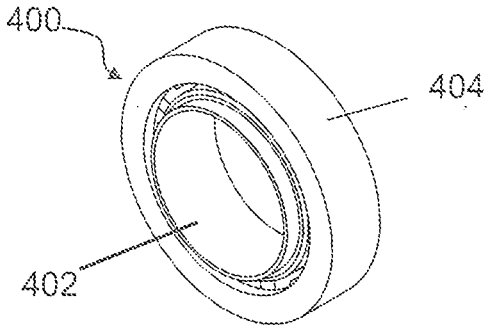
FIG. 21 is a perspective view of a bearing assembly for use with a shade assembly, in accordance with certain aspects of the present invention.
Figure 22:
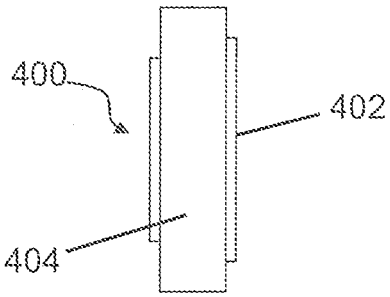
FIG. 22 is a front view of the bearing assembly shown in FIG. 21, in accordance with certain aspects of the present invention.

FIGS. 19 and 20 illustrate a safety strap assembly 300 that may be used to further stabilize the connection area between adjacent shade assemblies 20 where the mounting bracket 40 supports the connector assembly 100. As shown in FIG. 20, the mounting bracket 40 may be provided with a strap slot 47 so that the safety strap assembly 300 may be mounted using a fastener 302. With the mounting bracket 40 secured to a stationary object using the mounting bracket fasteners 49, the fastener 302 may be extended through a mounting plate portion 304 of the strap assembly 300 so that a curved safety arm portion 306 extends around at least a portion of the locating ring 130 of the connector assembly 100. The safety arm 306 may be configured to cradle a portion of the locating ring 130 in the event of a failure of one or more components of the connector assembly 100 and/or the mounting bracket 40, preventing the shade system 10 from falling. There is sufficient clearance between the safety strap assembly 300 and the connection components such as there is no rubbing or binding during operation of the shade system 10, regardless of the orientation of the mounting bracket 40 or the angle positions of the shade assemblies 20.

Figure 23:
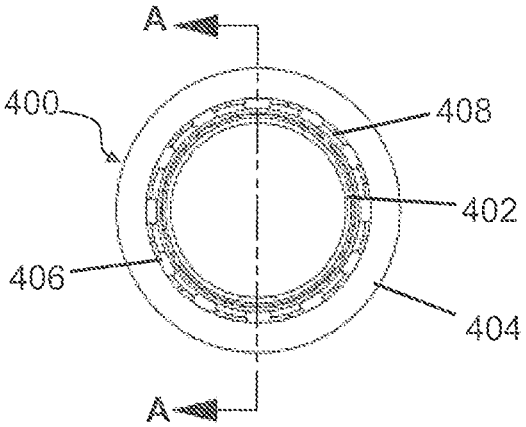
FIG. 23 is a right side view of the bearing assembly shown in FIG. 21, in accordance with certain aspects of the present invention.
Figure 24:
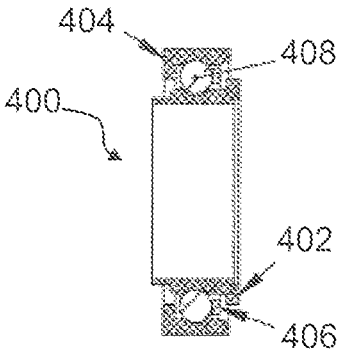
FIG. 24 is a cross-sectional view of the bearing assembly taken along sectional line A-A, in accordance with certain aspects of the present invention.

FIGS. 21-24 illustrate aspects of a bearing assembly 400 that may be used with respect to the connector assembly 100 (i.e., bearing assembly 131) and the articulating connecting assembly 201 (i.e., bearing assembly 231). The bearing assembly 400 may include an inner race 402 and an outer race 404, both made of a low viscosity acetal copolymer, for example. As shown in FIGS. 23 and 24, the bearing assembly 400 may also include a bearing cage 406 and a plurality of bearing elements 408 secured by the bearing cage 406 between the inner race 402 and the outer race 404. In accordance with aspects of the present disclosure, the bearing cage 406 may be made of a polytetrafluoroethylene (PTFE) material coated or infused with a lubricating compound, such as teflon, and configured to hold and separate the bearing elements 408 from making contact with each other. In accordance with yet other aspects of the present disclosure, the bearing elements 408 may be ball bearings made of a material, such as glass, that is resistant to producing an electrical charge during rotation. The glass ball bearing elements 408 are thus susceptible to absorbing or being coated with the teflon PTFE material through rubbing contact of the bearing elements 408 with the bearing cage 406 as they roll in the bearing cage 406. The bearing assembly 400 may thus be a dry, self-lubricating assembly comprising a minimal number of parts that is capable of efficient and effective operation for extremely long periods of time without required maintenance or additional lubrication.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A shade system comprising:

at least two shade assemblies each including an elongated shade tube having an inner surface defining an inner cavity, an outer surface for winding receipt of a flexible shade, at least one coupling end, and an axis of rotation;

a connector assembly having a first coupling unit secured to the inner surface at the coupling end of a first shade tube and a second coupling unit secured to the inner surface at the coupling end of a second shade tube substantially adjacent the first shade tube, the first coupling unit and the second coupling unit cooperating to transfer an applied torque from the first shade tube to the second shade tube;

a pair of end brackets for rotatably supporting a free end portion of a respective shade tube when attached to a supporting structure;

an adjustment ring configured to rotate to move two shades assemblies axially with respect to each other;

at least one mounting bracket with an adjustment mechanism to apply an external force to the connector assembly along at least one axis substantially orthogonal to the axis of rotation of at least one of the first and second shade tubes for positional alignment of the connector assembly when the mounting bracket is attached to a supporting structure and a motor assembly provided in the inner cavity of only one of the shade tubes, wherein actuation of the motor assembly controls the uniform movement of at least two shade tubes.

2. The system of claim 1, wherein the connector assembly includes a locating ring configured to engage the adjustment mechanism.

3. The system of claim 1, wherein the adjustment mechanism includes an adjustment nut that is rotated to adjust the positional alignment of the connector assembly along the at least one axis substantially orthogonal to the axis of rotation of at least one of the shade tubes.

4. The system of claim 1, wherein the mounting bracket includes a plurality of adjustment mechanisms for applying a plurality of external forces to the connector assembly along a plurality of axes.

5. The system of claim 1, wherein said first coupling unit and said second coupling unit are secured together via a threaded connection.

6. The system of claim 2, wherein the connector assembly includes at least one bearing assembly arranged concentrically with the locating ring to permit uniform rotation of the first and second coupling units with respect to the mounting bracket and the locating ring.

7. The system of claim 1, further comprising at least one of any of a radio frequency (RF) motor controller assembly, a power supply assembly, and a counterbalance assembly mounted in the inner cavity of at least one of the plurality of shade tubes.

8. The system of claim 7, wherein at least one of any of the RF motor controller assembly, the power supply assembly, and the counterbalance assembly are provided in at least one separate shade tube from the shade tube containing the motor assembly.

9. The system of claim 8, wherein the first and second coupling units are configured to permit passage of wiring to electrically connect the motor assembly and one or more of the RF motor controller assembly and the power supply assembly.

10. The system of claim 1, wherein said first coupling unit and said second coupling unit are secured together via a drive journal.

11. The system of claim 2, wherein a safety strap assembly is fastened to the mounting bracket in non-contact arrangement with the shade assemblies to secure the locating ring when the connector assembly experiences an unexpected movement relative to the mounting bracket.

12. The system of claim 6, wherein the bearing assembly includes an inner race, an outer race, a bearing cage secured between the inner race and the outer race, and a plurality of bearing elements, each bearing element rotatably secured and separated from the other bearing elements by the bearing cage.

13. The system of claim 12, wherein the bearing cage comprises a polytetrafluoroethylene (PTFE) material coated or infused with teflon.

14. The system of claim 13, wherein the bearing elements are glass ball bearings.

15. The system of claim 10, wherein the drive journal includes a ball end portion and the first coupling unit includes a socket for receiving the ball end portion to define a constant velocity joint for transferring torque between adjacent shade tubes positioned with angularly aligned axes of rotation.

16. The system of claim 4, wherein the mounting bracket includes a mounting plate for mounting at least one of the adjustment mechanisms to apply force against the locating ring along a first axis and an extended arm for mounting another of the adjustment mechanisms to apply force to the locating ring along a second axis substantially orthogonal to the first axis.

17. A shade system comprising:

a plurality of shade assemblies;

a connector assembly having a first coupling unit removably attached to an end of one of the plurality of shade assemblies, a second coupling unit removably attached to an end of another one of the plurality of shade assemblies and coupled to the first coupling unit, and a locating ring for receiving an applied force to move the position of the connector assembly in response to a drag on a rotation of the coupled shade assemblies; and an adjustment ring configured to rotate to move two shade assemblies axially with respect to each other.

18. The shade system of claim 17, further comprising:

a mounting bracket having an adjustment mechanism to apply force to the locating ring along at least one axis substantially orthogonal to an axis of rotation of at least one of the connected tubular shade assemblies for positional alignment of the connector assembly when the mounting bracket is attached to a supporting structure.

19. The system of claim 18, wherein the adjustment mechanism includes an adjustment nut that is rotated to adjust the positional alignment of the connector assembly along the at least one axis.

20. The system of claim 17, wherein the connector assembly includes at least one bearing assembly arranged concentrically with the locating ring to permit uniform rotation of the first and second coupling units with respect to the mounting bracket.

21. The system of claim 17, wherein each of the plurality of shade assemblies defines an inner cavity, and further comprising:

a motor assembly provided in the inner cavity of at least one of the plurality of shade assemblies, wherein actuation of the motor assembly enables a uniform rotational movement of the all of the shade assemblies.

22. The system of claim 21, further comprising a radio frequency (RF) motor controller assembly, a power supply assembly and the counterbalance assembly is mounted in the inner cavity of a shade tube not containing a motor assembly.

23. The system of claim 22, wherein at least one of any of the RF motor controller assembly, the power supply assembly, and the counterbalance assembly are provided in at least one separate shade tube from the shade tube containing the motor assembly.

24. The system of claim 22, wherein the first and second coupling units are configured to permit passage of wiring to electrically connect the motor assembly and one or more of the RF motor controller assembly and the power supply assembly.

25. The system of claim 17, wherein said first coupling unit and said second coupling unit are coupled via a drive journal.

26. The system of claim 25, wherein the drive journal includes a ball end portion and the first coupling unit includes a socket for receiving the ball end portion for coupling adjacent shade assemblies at an angle.

27. A shade comprising:

a first shade assembly having an elongated shade tube with a flexible shade attached to the elongated shade tube;

a second shade assembly having an elongated shade tube with a flexible shade attached to the elongated shade tube;

a connector assembly attached to an end of the first shade assembly and an end of the second shade assembly;

the connector assembly having a locator ring; and the connector assembly including a mounting bracket having an adjustment mechanism to apply force to the locating ring along at least one axis substantially orthogonal to an axis of rotation of the first shade assembly or the second shade assembly or positional alignment of the connector assembly when the mounting bracket is attached to a support structure; and an adjustment ring configured to rotate to move two shade assemblies axially with respect to each other.

28. The system of claim 7, wherein the counterbalance assembly mounted in the inner cavity of a of shade tube that does not have a motor.

29. The shade system of claim 1, wherein the adjustment ring, the first coupling unit, and the second coupling unit are threadably connected to each other.

* * * * *